US008077191B2

(12) United States Patent
Brewington et al.

(10) Patent No.: US 8,077,191 B2
(45) Date of Patent: Dec. 13, 2011

(54) ERASE AND WRITING CONTINUOUS FOR ERASABLE MEDIA

(75) Inventors: Grace T. Brewington, Fairport, NY (US); Anthony S. Condello, Webster, NY (US); Daniel Martin Bray, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 185 days.

(21) Appl. No.: 12/542,405

(22) Filed: Aug. 17, 2009

(65) Prior Publication Data

US 2011/0037820 A1 Feb. 17, 2011

(51) Int. Cl.
*B41J 2/32* (2006.01)

(52) U.S. Cl. ..... 347/171; 347/223

(58) Field of Classification Search ..... 347/171, 347/223; 400/120.01
See application file for complete search history.

(56) References Cited

U.S. PATENT DOCUMENTS

2007/0165094 A1 7/2007 Matsumura et al.

FOREIGN PATENT DOCUMENTS

| | | |
|---|---|---|
| EP | 1857289 | 11/2007 |
| JP | 2001277491 | 10/2001 |
| WO | 2004034380 | 4/2004 |

OTHER PUBLICATIONS

European Patent Office, European Search Report, European Application No. 10172510.9, Oct. 29, 2010, 6 pages.

*Primary Examiner* — Huan Tran
(74) *Attorney, Agent, or Firm* — MH2 Technology Law Group LLP

(57) ABSTRACT

An imaging device includes an input for supplying an erasable medium to the imaging device, the erasable medium comprising at least one of an imaged and a non-imaged erasable medium. The imaging device further includes an erase subsystem comprising active and inactive states, the erase subsystem erasing an imaged erasable medium in an active state, a cooling subsystem for selectively cooling an erased medium, and a write subsystem for imaging a received medium. The device further includes a user interface for configuring the imaging device and a sensor for detecting the type of input medium.

16 Claims, 3 Drawing Sheets

ERASE AND WRITING CONTINUOUS FOR ERASABLE MEDIA

DESCRIPTION OF THE INVENTION

1. Field of the Invention

This invention relates generally to imaging and, more particularly, to erasing and imaging erasable media in an imaging device.

2. Background of the Invention

Paper documents are often promptly discarded after being read. Although paper is relatively inexpensive, the quantity of discarded paper documents is enormous and the disposal of these discarded paper documents raises significant cost and environmental issues. It would, therefore, be desirable for paper documents to be reusable, to minimize both cost and environmental issues.

Erasable media is that which can be reused many times to transiently store images, the images being written on and erasable from the erasable media. For example, photochromic paper employs photochromic materials to provide an imageable surface. Typically, photochromic materials can undergo reversible or irreversible photoinduced color changes in the photochromic containing layer. In addition, the reversible photoinduced color changes enable imaging and erasure of photochromic paper in sequence on the same paper. For example, a light source of a certain wavelength can be used for imaging erasable media, while heat can be used for inducing erasure of imaged erasable media. An inkless erasable imaging formulation is the subject of U.S. patent application Ser. No. 12/206,136 filed Sep. 8, 2008 and titled "Inkless Reimageable Printing Paper and Method" which is commonly assigned with the present application to Xerox Corp., and is incorporated in its entirety herein by reference.

Because imaging of erasable media has unique requirements, it has previously required dedicated equipment. In particular, a UV source can be required to image the erasable media, and heat can be required to erase an imaged erasable media. In addition, specific temperature parameters are required for each of the imaging and erasing of erasable media. While traditional imaging devices are suitable for performing conventional imaging of non-erasable media, their architecture can be insufficient for handling erasable media alone or in combination with non-erasable media.

Thus, there is a need to overcome these and other problems of the prior art and to provide an imaging system in which imaged and non-imaged erasable media can be selectively erased and imaged in a single pass through the imaging system. Even further, the imaging device should be capable of interchangeably sharing components and efficiently processing work.

SUMMARY OF THE INVENTION

According to various embodiments, the present teachings include an imaging device. The imaging device includes an input for supplying an erasable medium to the imaging device, the erasable medium including at least one of an imaged and a non-imaged erasable medium. An erase subsystem includes active and inactive states, the erase subsystem erasing an imaged erasable medium in an active state. A cooling subsystem selectively cools an erased medium. A write subsystem UV images a medium received therein.

According to various embodiments, the present teachings also include a method for continuous erase and writing in an imaging system. In this method, an erasable medium is supplied to an imaging device, the erasable medium including at least one of an imaged and a non-imaged erasable medium. The method further includes selectively erasing in input medium according to a type of job, selective cooling an erased erasable medium to a UV imaging temperature at a cooling subsystem, and UV imaging an erasable medium received at a write subsystem, wherein the supplied erasable medium continuously feeds through the system in a single pass.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

As used herein, the term "erasable media" refers to transient material that has the appearance and feel of traditional paper, including cardstock and other weights of paper. Erasable media can be selectively imaged and erased.

As used herein, imaged erasable media refers to erasable media having a visible image thereon, the image a result of, for example, ultraviolet (UV) imaging of the erasable media.

As used herein, non-imaged erasable media refers to erasable media which has not been previously imaged, or erasable media having an image erased therefrom and available for UV imaging. An exemplary erasable medium is described in connection with FIG. 1 below.

As used herein, the term "non-erasable" refers to traditional media of the type used in any conventional imaging such as ink jet, xerography, or liquid ink electrophotography, as known in the art. An example of a non-erasable traditional medium can be conventional paper.

Figure 1:
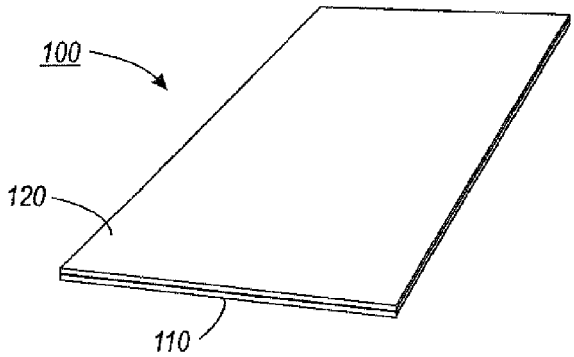
FIG. 1 is a perspective depiction of an erasable medium having a photochromic coating which allows for writing an image in the coating on the page and for erasing an image from the coating.

FIG. 1 depicts an exemplary erasable medium 100 in accordance with the present teachings. It should be readily apparent to one of ordinary skill in the art that the erasable medium 100 depicted in FIG. 1 represents a generalized schematic illustration and that other layers can be added or existing layers can be removed or modified.

As shown in FIG. 1, the erasable medium 100 can include a substrate 110 and a photochromic material 120 incorporated into or on the substrate 110. The photochromic material 120 can provide a reversible writing (i.e. erasable) image-forming component on the substrate 110.

The substrate 110 can include, for example, any suitable material such as paper, wood, plastics, fabrics, textile products, polymeric films, inorganic substrates such as metals, and the like. The paper can include, for example, plain papers such as XEROX® 4024 papers, ruled notebook paper, bond paper, and silica coated papers such as Sharp Company silica coated paper, Jujo paper, and the like. The substrate 110, such as a sheet of paper, can have a blank appearance.

In various embodiments, the substrate 110 can be made of a flexible material and can be transparent or opaque. The substrate 110 can be a single layer or multi-layer where each layer is the same or different material and can have a thickness, for example, ranging from about 0.05 mm to about 5 mm.

The photochromic material 120 can be impregnated, embedded or coated to the substrate 110, for example, a porous substrate such as paper. In various embodiments, the photochromic material 120 can be applied uniformly to the substrate 110 and/or fused or otherwise permanently affixed thereto.

Portion(s) of photochromic material of an imaged erasable medium 100 can be erased. In order to produce the transition from a visible image to an erased medium, heat can be applied to the erasable medium 100 at a temperature suitable for effecting the erasure. For example, at a temperature between about 80° C. to about 200° C., the erasable medium 100 can be completely erased. In order to re-image the erased (or image an original) erasable medium 100, the erasable medium 100 can be heated to a temperature of between about 55° C. to about 80° C. before writing using, for example, UV exposure.

It will be appreciated that other types of erasable media, other than photochromic paper, can be used in connection with the exemplary embodiments herein. Such types of erasable media are intended to be included within the scope of the disclosure.

Figure 2:
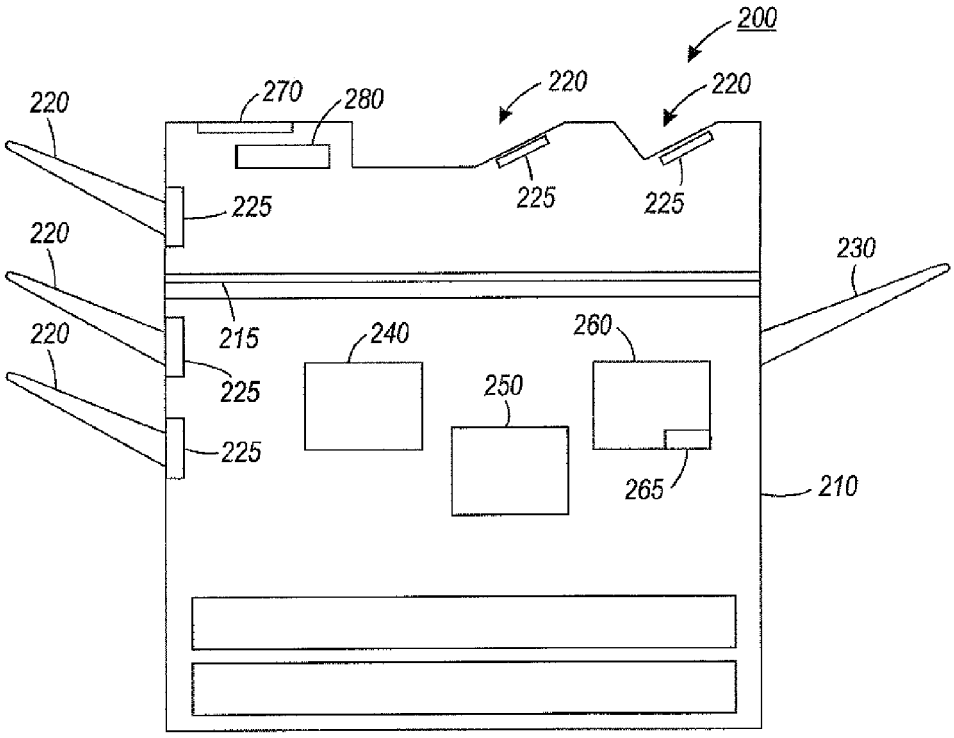
FIG. 2 depicts an imaging apparatus in accordance with the present teachings.

FIG. 2 depicts an exemplary imaging system 200 in accordance with the present teachings. It should be readily apparent to one of ordinary skill in the art that the imaging system 200 depicted in FIG. 2 represents a generalized schematic illustration and that other components can be added or existing components can be removed or modified.

As shown in FIG. 2, the imaging system 200 can include a housing 210 with media input 220 and media output 230 locations. In addition, the imaging system 200 can include a platen 215, an erase subsystem 240, a cooling subsystem 250, a write subsystem 260, a user interface 270, and a control system 280.

The housing 210 can be of a material and size to accommodate the exemplary components of the imaging system 200. In certain embodiments, the housing 210 can include a desktop device. The housing 210 can further include a full size floor supported device. Sizes for each are known in the art and not intended to limit the scope of the invention.

The media inputs 220 can include one or more input trays for each of an imaged erasable media, non-imaged erasable media, and mixed imaged and non-imaged erasable media. The erasable media will not be specifically labeled as to type in the following figures, because they are translated between types according to a position within the imaging system 200. As used herein, a non-imaged erasable media can include those which have been previously erased yet not immediately imaged subsequent to erase. Other combinations of erasable media are intended to be within the scope of the disclosure.

In certain embodiments, a sensor 225 can be provided to detect a type of erasable media entering the imaging device 200. The sensor 225 can be proximate each input tray 220, incorporated in the input tray 220, or interior of the housing 210. For example, the sensor 225 can detect an imaged erasable medium and, in combination with control system 280, direct that medium in a single pass through the system in order to erase, cool, and image the erasable medium. By way of further example, the sensor 225 can detect a non-imaged erasable medium and, in combination with the control system 280, direct that medium in a single pass through the system in order to image the document, for example by UV imaging. The sensor 225 can include a microdensitometer, a full width array scan bar, or the like.

The erase subsystem 240 can include hardware suitable for erasing photochromic erasable media. The erase subsystem 240 can include a heating mechanism or heater. In embodiments, the erase subsystem 240 can include heat rolls, heating lamps, heating pads, and temperature and power controls.

In general, the erase subsystem 240 can operate to generate heat in a range of about 80° C. to about 200° C. The erase subsystem 240 can further operate to generate heat in a range of about 90° C. to about 170° C. A further exemplary erase temperature can be about 160° C. At a determined erase temperature, the erase subsystem 240 can erase an imaged erasable medium. In certain embodiments, the erase subsystem 240 can be utilized to heat a non-imaged erasable medium to a temperature suitable for imaging at the write subsystem 260. Imaging can be by UV imaging.

The cooling subsystem 250 can include active cooling of erasable media. The cooling subsystem 250 can include passive cooling of erasable media. In an active cooling, the cooling subsystem 250 can direct a flow of cooling medium, such as cold air, onto an erasable medium. Active cooling can take place for a period of time and temperature suitable to reduce a temperature of the erasable medium to an ambient temperature. Further, active cooling can take place for a period of time and at a temperature suitable to reduce the temperature of the erasable medium to an imaging temperature, such as a UV imaging temperature. In certain embodiments, active cooling by the cooling subsystem 250 can include a fan. In certain embodiments, active cooling of the erasable medium at the cooling subsystem 250 can include cold plates, rollers, condensers, and similar cooling apparatus acting on or adjacent to the erasable medium.

The cooling subsystem 250 can further be incorporated into an erasable media handling cycle to cool an imaged erasable medium subsequent to UV imaging. In certain embodiments, the UV imaged erasable medium can therefore be cooled prior to discharge from the dual mode imaging device 200 into the output tray 230.

In certain embodiments, the write subsystem 260 can include imaging components, such as UV imaging components. The write subsystem 260 can image an erasable media once the erasable medium reaches a predetermined temperature. An exemplary UV imaging temperature of an erasable medium can be in a range between about 55° C. to about 80° C. A UV imaging temperature can be about 65° C. Other UV imaging temperatures can be set according to a type of erasable medium and such imaging temperatures are intended to be included within the scope of the invention. It will be appreciated that the temperature of the erasable medium can be established within the write subsystem 260 by a heater 265 incorporated therein. Likewise, the temperature of the erasable medium can be established at the erase subsystem 240 by initiating a temperature therein less than an erase temperature. For example the erase subsystem 240 can heat an erasable medium to a temperature suitable for UV imaging at the write subsystem 260. In certain embodiments, the erasable medium at an imaging temperature can bypass the cooling subsystem 250 and directly enter the write subsystem 260 prior to cooling. In certain embodiments, the erasable medium can be elevated to a temperature above a suitable UV imaging temperature and below an erase temperature, such that passage through the cooling subsystem 250 can assist in obtaining a target temperature of the erasable medium prior to imaging at the write subsystem 260.

As indicated, the write subsystem 260 can include a heating mechanism 265 for heating the erasable medium to a temperature suitable for UV imaging. In this instance, the detected non-imaged erasable medium can pass through the erase subsystem 240 (with the erase subsystem in an inactive mode) prior to entering the write subsystem 260. Alternatively, the detected non-imaged erasable medium can bypass the erase subsystem 240 and directly enter the write subsystem 260. Likewise, the detected non-imaged erasable medium can pass through the cooling subsystem 250 (with the cooling subsystem in an inactive mode) prior to entering the write subsystem 260. Alternatively the detected non-imaged erasable medium can bypass the cooling subsystem 250 and directly enter the write subsystem 260. In any case, whether one or more of the erase 240 and cooling 250 subsystems are utilized, a document can be imaged in a single pass through the system.

In certain embodiments, a user interface 270 can be provided in the housing 210. The user interface 270 can work with control system 280 components, responsive to user input, for directing the functions of the imaging system 200. In certain embodiments, the imaging system 200 can be configured through the user interface 270 to start up in a selected mode. Certain modes of operation can include erasing and imaging of imaged erasable media, imaging of non-imaged erasable media, and erasing and imaging of mixed imaged and non-imaged erasable media. Alternatively, the user interface 270 can prompt the operator to check for the proper media at the job start and to select a mode based upon the type of job requirements. The user interface 270 can further be responsive to the sensor 225 and control system 280 and the sensor 225 and control system 280 can be responsive to input at the user interface 270.

Figure 3:
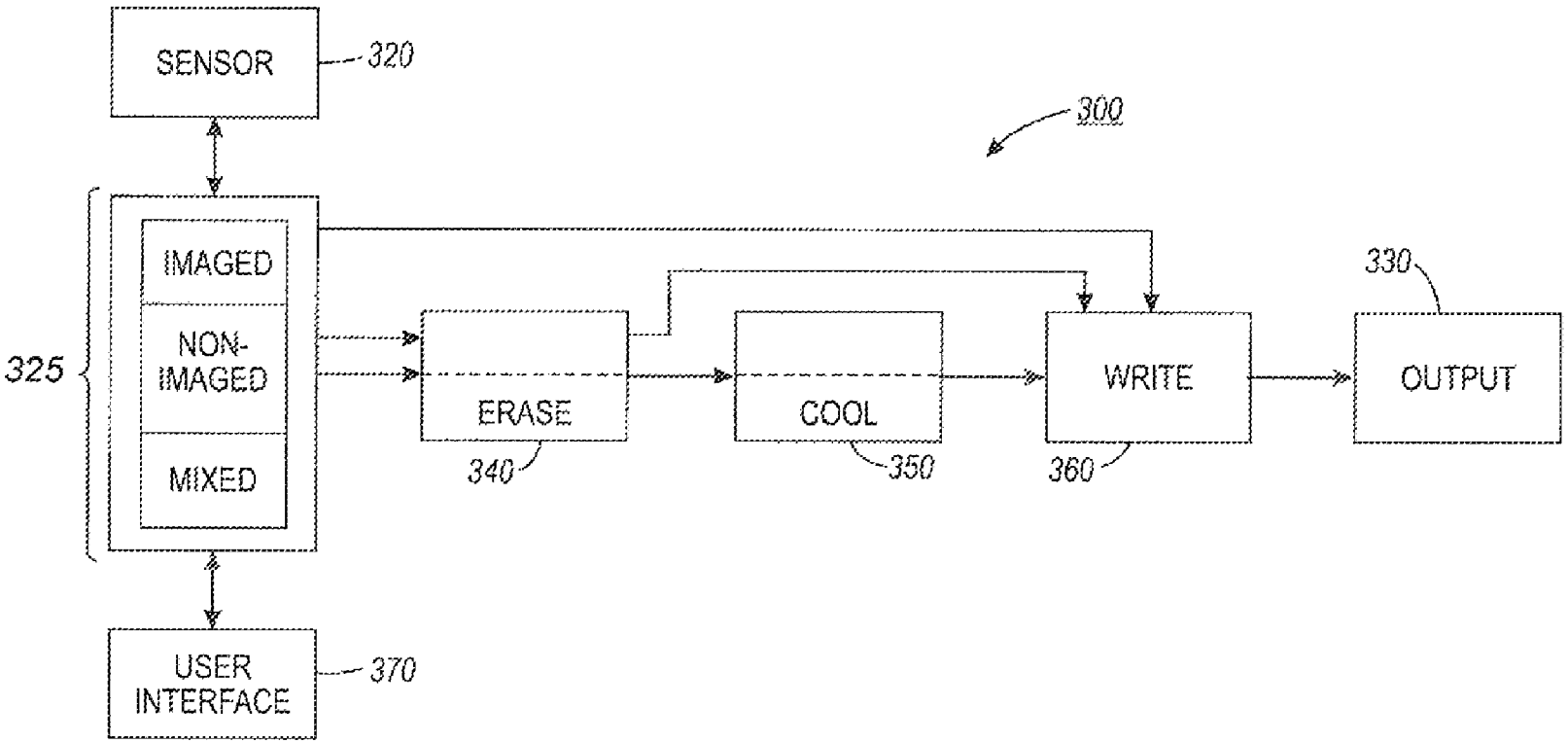
FIG. 3 is a schematic diagram depicting exemplary passages of erasable media within the imaging apparatus of FIG. 2 in accordance with the present teachings.

FIG. 3 is a schematic illustration depicting a system 300 of exemplary passages of erasable media in accordance with the present teachings. It should be readily apparent to one of ordinary skill in the art that the examples depicted in FIG. 3 represents a generalized schematic illustration and that other components can be added or existing components can be removed or modified.

In certain embodiments, the exemplary passages of FIG. 3 can require the use of an input 320, a sensor 325, an erase subsystem 340, a cooling subsystem 350, a write subsystem 360, a user interface 370, and an output 330. As indicated above, the erase subsystem 340 can erase a photochromic erasable media. Further, the write subsystem 360 can image, via UV imaging, photochromic erasable media.

When an imaged erasable media is used or selected for imaging, for example according to a type of job, the imaged erasable media will first need to be erased before it can be imaged. In certain embodiments, the imaged erasable medium (whether sensed by sensor 325 or input at the user interface 370) can, in a single pass through the system, travel through the erase subsystem 340, followed by the cooling subsystem 350, and then followed by the write subsystem 360. Subsequent to the write subsystem 360, the imaged erasable media can be expelled from the system to output 330. At the erase subsystem 340, the imaged erasable media can be heated to a temperature suitable for erasing any image on the erasable medium. Further, the imaged erasable medium can reside in the erase subsystem 340 for a time corresponding to the suitable temperature to achieve an erasure. The erase subsystem 340 can be of a length or passage sufficient to house the imaged erasable medium for a duration which will enable erasure at a certain erase temperature. At the cooling subsystem 350, the erased erasable medium can be cooled, either actively or passively as described, to a temperature suitable for UV imaging at the write subsystem 360. At the write subsystem 360, the cooled erasable medium can be UV imaged. It will be appreciated that the write subsystem 360 can include a heating mechanism for elevating or maintaining the temperature of the cooled erasable medium to the temperature suitable for UV imaging.

When a non-imaged erasable medium is either selected or detected, for example according to a type of job, the non-imaged erasable medium can, in a single pass through the system 300, travel through or bypass the erase subsystem 340, travel through or bypass the cooling subsystem 350, and then enter the write subsystem 360 for imaging. In the figures, a dashed line depicts a pass through of erasable media through either the erase subsystem 340 or the cooling subsystem 350. When the erased erasable medium passes through the cooling subsystem 350 to the write subsystem 360, the cooling system 350 can be in an inactive state, i.e. only performing a feed function rather than a cool function. Subsequent to imaging, the imaged erasable medium can be expelled from the system 300, for example by automatic stacking on an output tray 330.

In certain embodiments, input into the system 300 can include a mix of both imaged and non-imaged erasable medium. Accordingly, the sensor 325, for example according to a type of job, can be utilized to detect a type of passing erasable medium, and the control system can initiate a corresponding predetermined cycle through the system. For example, if an imaged erasable medium is detected, then the imaged erasable medium can, in a single pass, travel through the erase subsystem 340, the cooling subsystem 350 and the write subsystem 360 prior to being discharged from the system 300. By way of further example, if a non-imaged erasable medium is detected, then the non-imaged erasable medium can, in a single pass, travel through or bypass the erase subsystem 340, travel through or bypass the cooling subsystem 350 and travel through the write subsystem 360 prior to being discharged from the system 300. The sensor 325 can be operable per erasable medium, and regardless of the number of mixed or unmixed erasable media, the control system thereby correctly initiating a predetermined path through the system in a single pass.

Figure 4:
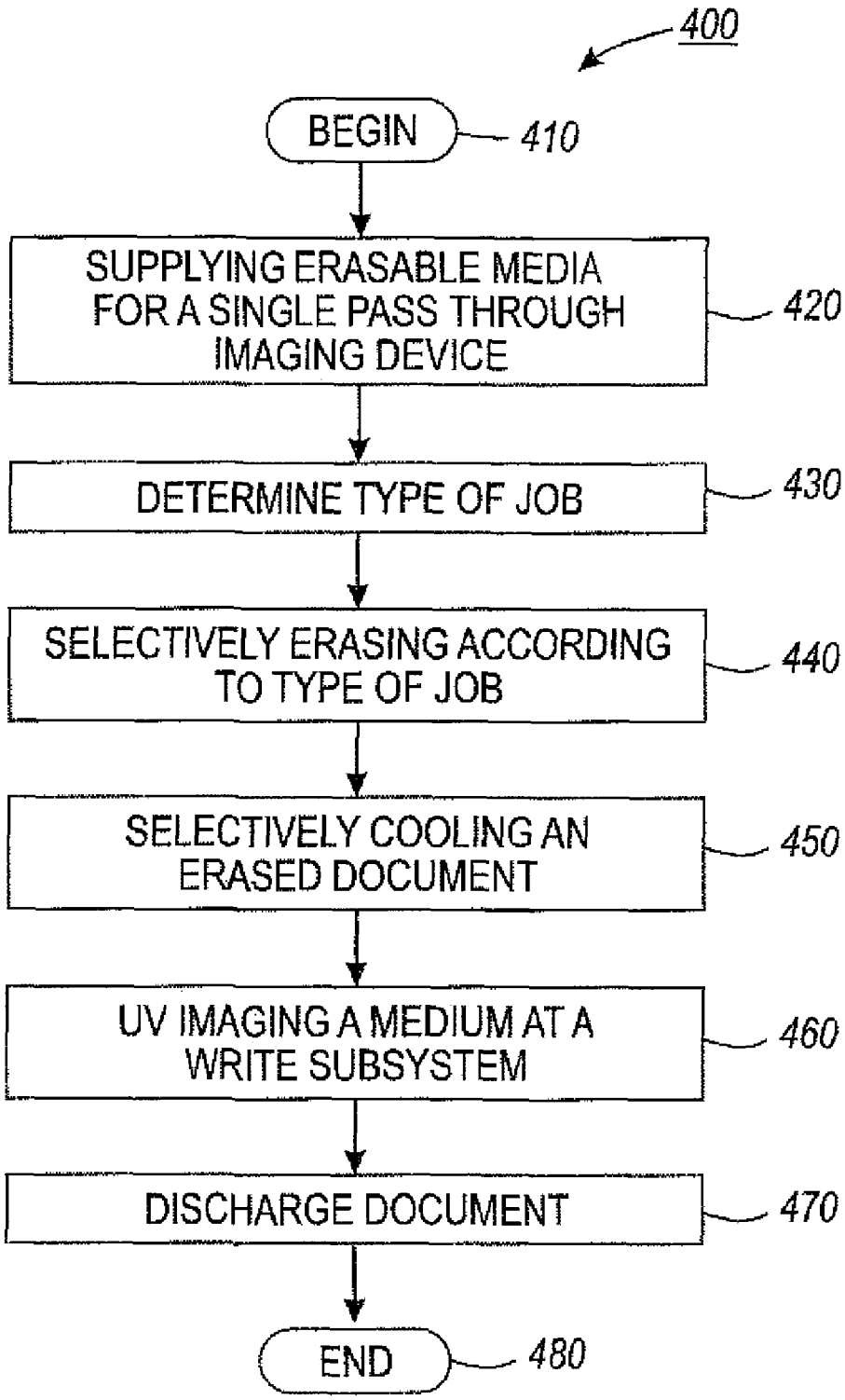
FIG. 4 depicts an exemplary method for utilizing the imaging apparatus in accordance with the present teachings.

FIG. 4 discloses a method 400 for imaging in accordance with the present teachings. It should be readily apparent to one of ordinary skill in the art that the method 400 represents a generalized schematic illustration and that other components can be added or existing components can be removed or modified.

The method can begin at 410. At 420, an erasable medium is supplied for a single pass through the imaging device. The erasable medium can include at least one of an imaged erasable medium, a non-imaged erasable medium, and mixed imaged and non-imaged erasable media. The erasable media can be supplied to the imaging device from at least one tray, a platen, or the like.

At 430, a type of job can be determined. This determination can be by a sensor positioned proximate the document or at a location by which the erasable medium will pass. The type of job can also be made by visual observation of a user. In such a case, the user can input a selection into a user interface, instructing the imaging device as to a type of document being imaged, or erased and then imaged.

At 440, selective erasing can occur according to type of erasable medium detected or job selected. In particular, if an imaged erasable medium is detected or job selected, then the imaged erasable medium can be erased via the selective erasing. Conversely, erasing will not be selected by the imaging device in the event of a non-imaged erasable medium being detected or job selected. In this instance, the non-imaged erasable medium can bypass an erase substation. In this instance, the non-imaged erasable medium can pass through the erase substation, while the erase substation is inactive.

At 450, selective cooling can occur according to whether or not an erasable medium has been in an active erase subsystem. If an erasable medium has been erased, the erasable medium can be cooled at the cooling subsystem. If an erasable medium has not required erasing, the erasable medium can pass through or bypass the cooling subsystem according to system design. In the event of a pass through, the cooling subsystem can be inactive.

At 460, UV imaging an erasable medium at a write subsystem can occur. Imaging can be of an erased erasable medium which has passed through the erase subsystem and the cooling subsystem. Imaging can be of an erasable medium which has bypassed the erase subsystem and the cooling subsystem. Imaging can be of an erasable medium which has passed through each of the erase subsystem and cooling subsystem while each are inactive with respect to their heating and cooling functions, respectively. Imaging can be of an erasable medium which has bypassed the erase subsystem and passed through the cooling subsystem with the cooling subsystem in an inactive state. Imaging can be of an erasable medium which has passed through an inactive erase subsystem and bypassed the cooling subsystem. Certain other flows of an erasable medium will be apparent to those skilled in the art. In each instance, an erasable medium only takes a single pass through the entire system.

At 470, the erasable medium can be discharged. Discharge can be to an exterior of the system, for example to an output tray or the like.

At 480, the method can end, but the method can return to any point and repeat.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An imaging device comprising:

an input for supplying an erasable medium to the imaging device, the erasable medium comprising at least one of an imaged and a non-imaged erasable medium;

a sensor configured to detect if the erasable medium includes the imaged or non-imaged erasable medium;

an erase subsystem configured to receive the erasable medium if the sensor detected that the erasable medium includes an image and erase the imaged erasable medium;

a cooling subsystem for selectively cooling an erased medium; and a write subsystem configured to receive and image the erasable medium.

2. The device of claim 1, wherein the write subsystem comprises a UV light source.

3. The device of claim 1, further comprising a user interface for configuring the imaging device.

4. The device of claim 1, wherein the imaging device comprises one of a write only mode and an erase/write mode.

5. The device of claim 4, wherein the write only mode is active for a detected non-imaged erasable medium independent of the erase subsystem.

6. The device of claim 4, wherein the write only mode is active for a detected non-imaged erasable medium in response to supply of the non-imaged erasable medium from an inactive erase subsystem.

7. The device of claim 1, wherein the sensor is positioned in advance of the erase subsystem.

8. The device of claim 1, wherein the cooling subsystem comprises a temperature suitable for UV imaging.

9. The device of claim 1, wherein the cooling subsystem comprises at least one of active and passive cooling devices.

10. The device of claim 1, wherein the input comprises at least one feed tray.

11. The device of claim 1, wherein the medium comprises photochromic paper.

12. A method of continuous erase and writing in an imaging system, the method comprising:

supplying an erasable medium to an imaging device, the erasable medium comprising at least one of an imaged and a non-imaged erasable medium;

detecting, by a sensor, if the erasable medium includes the imaged or non-imaged erasable medium;

selectively erasing the erasable medium, at an erase subsystem, if the sensor detected that the erasable medium includes an image;

selectively cooling the erasable medium to a UV imaging temperature at a cooling subsystem; and selectively imaging the erasable medium at a write subsystem.

13. The method of claim 12, further comprising configuring the imaging device via a user interface.

14. The method of claim 13, wherein configuring comprises selecting of one of a write only mode and an erase/write mode.

15. The method of claim 12, wherein a detected non-imaged erasable medium bypasses the erase subsystem in a write only mode.

16. The method of claim 12, wherein a detected non-imaged erasable medium passes through an inactive erase subsystem in a write only mode.

* * * * *